US006902290B2

(12) United States Patent
Watts et al.

(10) Patent No.: US 6,902,290 B2
(45) Date of Patent: Jun. 7, 2005

(54) FINGER-MOUNTED LIGHT FOR VARIABLE LIGHT OUTPUT

(75) Inventors: Harry L. Watts, Santa Barbara, CA (US); Ronald E. Lisec, Charlotte, NC (US)

(73) Assignee: R & H Industries, Inc., Santa Barbara, CA (US)

( * ) Notice: Subject to any disclaimer, the term of this patent is extended or adjusted under 35 U.S.C. 154(b) by 133 days.

(21) Appl. No.: 10/633,116

(22) Filed: Aug. 1, 2003

(65) Prior Publication Data

US 2004/0032750 A1 Feb. 19, 2004

Related U.S. Application Data

(60) Provisional application No. 60/400,471, filed on Aug. 2, 2002.

(51) Int. Cl.[7] ..... F21V 21/08

(52) U.S. Cl. ..... 362/103; 362/104; 362/191; 362/295; 362/555; 362/552; 362/570; 362/577; D26/39

(58) Field of Search ..... 362/103, 104, 362/190, 191, 295, 800, 552, 555, 570; D26/39

(56) References Cited

U.S. PATENT DOCUMENTS

| | | | | |
|---|---|---|---|---|
| 455,972 A | | 7/1891 | Oudin et al. | |
| 1,245,817 A | * | 11/1917 | Suserud | 362/103 |
| 3,638,011 A | | 1/1972 | Bain et al. | |
| 4,422,131 A | | 12/1983 | Clanton et al. | |
| 5,086,378 A | * | 2/1992 | Prince | 362/103 |
| 5,124,892 A | | 6/1992 | Lambert | |
| 5,450,293 A | * | 9/1995 | Hoffman | 362/570 |
| 5,632,548 A | | 5/1997 | Mayfarth | |
| 5,816,676 A | | 10/1998 | Koenen Myers et al. | |

* cited by examiner

*Primary Examiner*—Stephen F Husar
(74) *Attorney, Agent, or Firm*—Christopher Darrow, Esq.; Greenberg Traurig, LLP

(57) ABSTRACT

A finger-mounted light system includes an (LED) mounted in a casing adapted for strapping to one hand and operated by a light output control knob. A housing that includes a power source (e.g., battery) is strapped to the wrist and the LED casing is strapped to a finger, such that light emitted from the LED may be adjusted. A display is included on the housing for displaying the battery level.

17 Claims, 3 Drawing Sheets

FINGER-MOUNTED LIGHT FOR VARIABLE LIGHT OUTPUT

CROSS-REFERENCE TO RELATED APPLICATIONS

The contents of this application are related to the provisional patent application, Application No. 60/400,471 filed Aug. 2, 2002, entitled "Digit Light." The contents of this related provisional patent application are incorporated herein by reference.

BACKGROUND OF THE INVENTION

1. Field of the Invention

This invention relates to apparatus for improving visual feedback by illuminating a field such as a reading area, hobby area or any other field such as a surgical site during a medical procedure, and more particularly, to a finger-mounted light which, in the preferred embodiment, includes at least one light-emitting diode capable of emitting light of selected color.

2. General Background

This invention can be used for many different applications where a beam of light needs to be positioned near a work place. Some examples are the assembly of small components by hobbyists, reaching into dark passages by mechanics, assembly or inspection of electronic components, or surgery. Physicians/surgeons who operate within a patient's body require adequate illumination of the field of operation in order to work most effectively. Numerous methods are being used to provide illumination of the field of operation.

For example, overhead lights equipped with parabolic mirrors and polarizing lenses are being used as a general source of non-glare lighting. However, such overhead lights must often be redirected during dental, medical or other procedures to keep the light directed at the point of interest, and the need to readjust the overhead light creates a distraction and requires additional time. Moreover, when the mechanic, hobbyist, surgeon, or physician must lean over the patient or work area to closely observe the field of operation, the overhead light is blocked. In addition, the light source is so far removed from the work location that it is often not possible to direct the overhead light source deep into the area, such as within the patient's body.

It is also known to support a light source from a headband worn by a physician to illuminate an area being viewed by the physician. For example, within U.S. Pat. No. 4,616,257 to Kloots et al., a medical headlight apparatus is disclosed wherein a fiber optic cable transmits light to a headband worn by the physician. The headband supports a housing including an illuminating lens for directing light transmitted by the fiber optic cable toward the field being viewed by the physician. While being an improvement over the above-described overhead light source, the medical headlight apparatus disclosed by Kloots et al. still does not permit the physician or other user to position the light source closely proximate the patient's mouth or other field of operation, and accordingly, the user's hands may block the light from reaching the desired region within the field of operation.

To overcome these problems, a finger-mounted light, such as the one described in U.S. Pat. No. 5,086,378, may be used for illuminating the area. In that invention, for use by a pilot, a fiber optic finger light includes green and red light-omitting diodes (LED) mounted in a housing adapted for strapping to one hand and operated by a 3-position switch.

A lens is mounted forwardly of each of the light-emitting diodes and serves to selectively focus light from the light-emitting diodes on one end of one of a pair of light-transmitting fibers which extend through the housing and project from the housing in a flexible duplex fiber optic cable. The light housing is strapped to the wrist and the fiber optic duplex cable is strapped to a finger, such that red or green light emitted from the LED at the opposite end of the optic fiber by manipulation of the switch, may be focused on charts, instruments check lists and the like, in the aircraft.

However, the problem with this approach is the use of an on-off switch for illuminating the area. Clearly, such devices are aimed at being portable devices, and the need to conserve the battery power is extremely important (especially for critical care situations in medical facilities where it is undesirable to have the battery going dead during surgery).

SUMMARY OF THE INVENTION

Clearly there is a need for a device with an adjustable light output control and a visual means for depicting available battery power so as to adaptively change the settings on the device for conserving battery power.

Accordingly, in one aspect of the invention, a finger light producing a variable intensity light output for mounting on the wrist and finger of a user, comprises (i) a housing; (ii) a wrist strap attached to the housing for removably securing the housing on the wrist; (iii) an electrical cable extending from the housing for energizing a light-emitting diode (LED), the LED residing at a first end of the cable, wherein the first end of the cable is distal to the housing; (iv) finger attachment means for securing said LED to the finger; (v) a power source within the housing for delivering a current to the LED, and (vi) a light intensity control means connected to the housing for controlling the light output from the LED. The LED may be replaced with other types of light emitting devices, such as a bulb, as would be obvious to someone ordinarily skilled in the art. A lens may be placed at the light emitting end of the LED to focus the light output.

In one aspect of the invention, the light intensity control means includes a potentiometer. A knob on the housing may be used to control the light output from the LED. Furthermore, a display is included on the housing for monitoring the current (or voltage) output from the power source (viz., a battery). Thus, the light output may be controlled by the user, via the knob, by visually looking at the power level on the display. Additionally, the potentiometer is connected electrically between the power source and the LED. Moreover, the finger attachment means further comprises one or more finger straps attached to a casing that houses the LED.

The invention is further described with reference to the accompanying drawings.

BRIEF DESCRIPTION OF THE DRAWINGS

In order that the manner in which the above-recited advantages and objects of the invention are attained, as well as others which will become apparent, more particular description of the invention briefly summarized above may be had by reference to the specific embodiments thereof that are illustrated in the appended drawings. It is to be understood, however, that the appended drawings illustrate only typical embodiments of the invention and are therefore not to be considered limiting of its scope, for the invention may admit to other equally effective embodiments.

In the drawings.

DETAILED DESCRIPTION OF THE INVENTION

Figure 1:
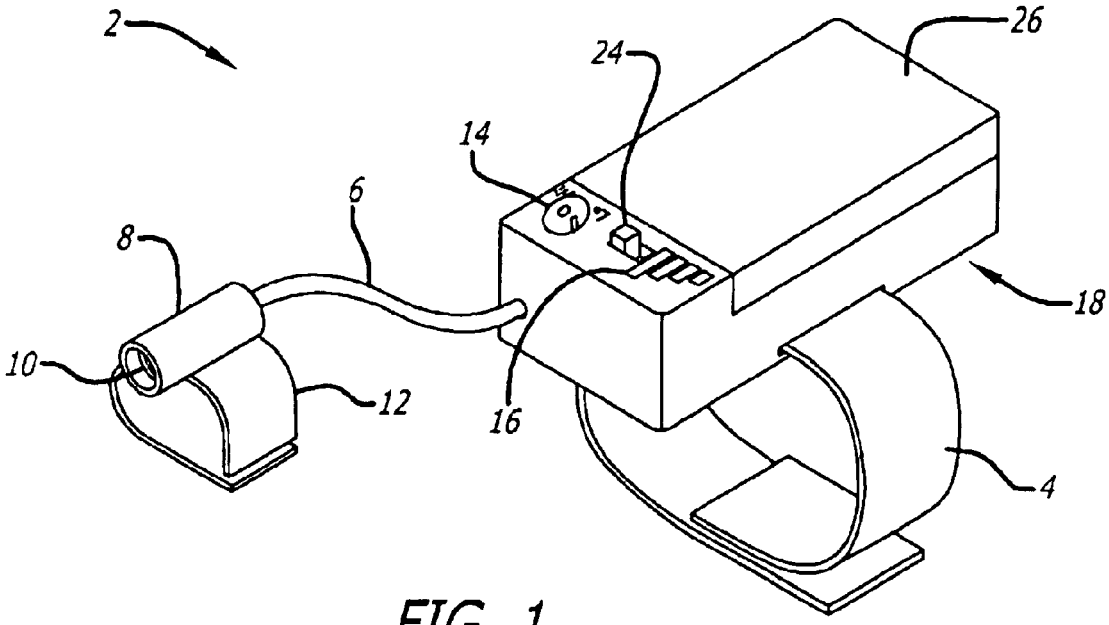
FIG. 1 is an isometric view of the finger light with a control knob for controlling light output, and a display means for monitoring battery power.

Referring now in detail and by reference characters to the drawings (FIGS. 1–6), which illustrate several different embodiments of the present invention, therein shown is a finger light with a control knob for controlling light output, and a display means for monitoring battery power. Such a system, as in the preferred embodiment of the present invention, employs circuit elements that allow display of the battery power levels and control of light power output from the LED to conserve battery power.

Figure 2:
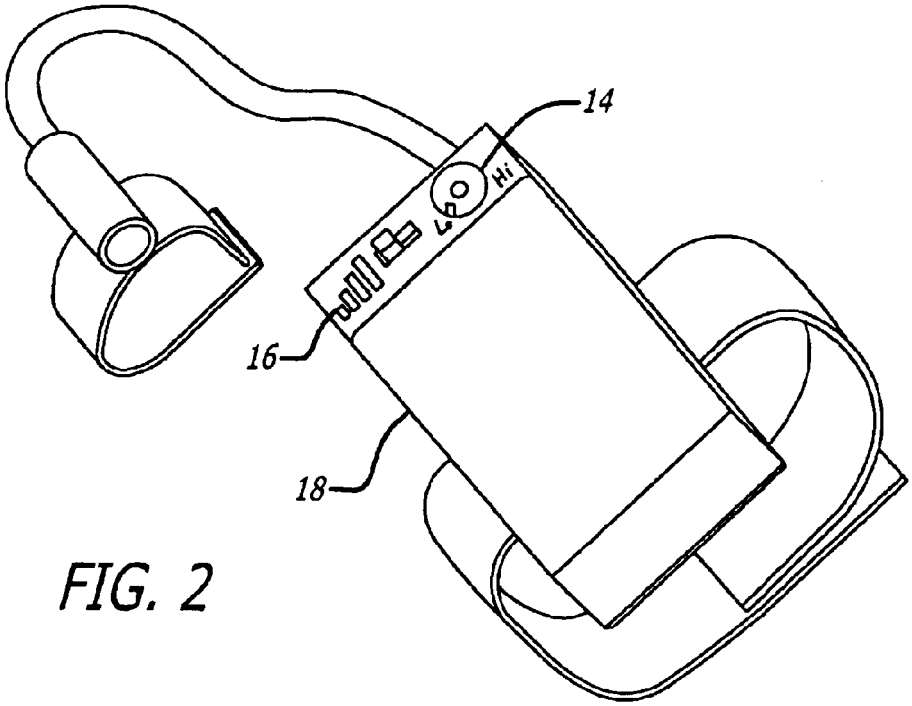
FIG. 2 is another view of the finger light with a control knob for controlling light output, and a display means for monitoring battery power.
Figure 3A:
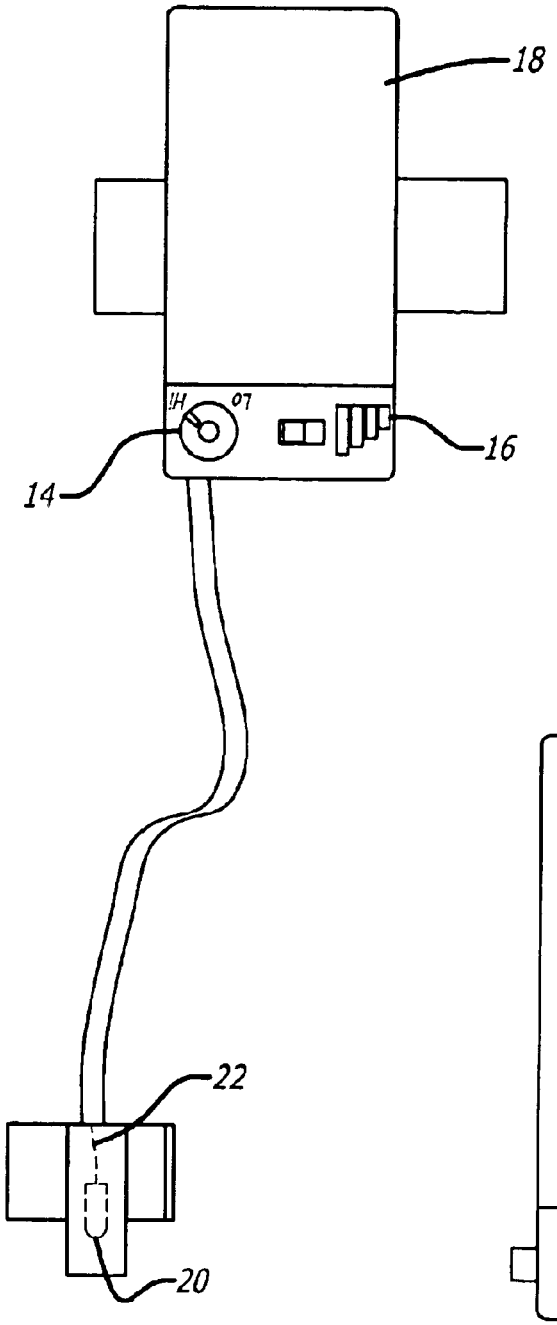
FIG. 3*a* is a top view of the finger light with a control knob for controlling light output, and a display means for monitoring battery power.
Figure 3B:
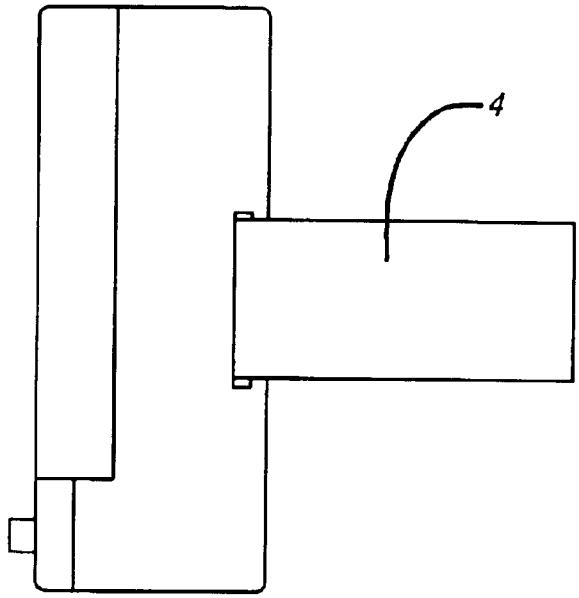
FIG. 3*b* is a side view of the finger light of FIG. 3*a;*
Figure 5:
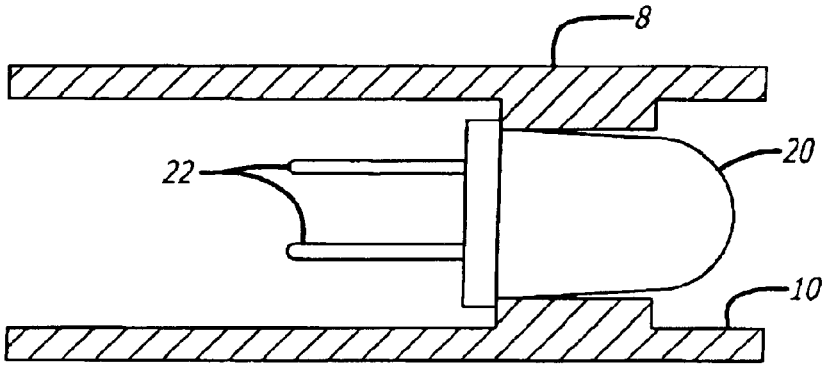
FIG. 5 is a longitudinal cross section of the casing for holding the LED, with an LED inserted.
Figure 6:
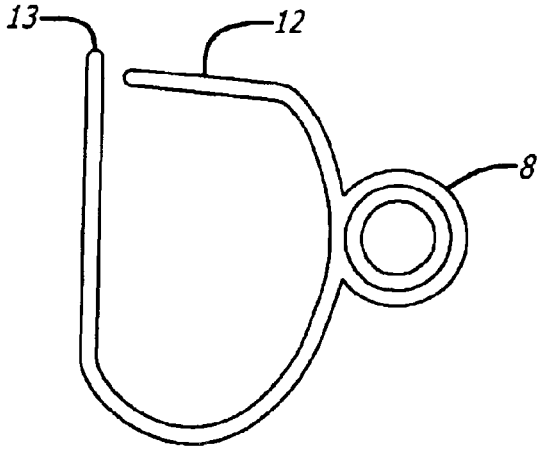
FIG. 6 is cross section of the finger attachment mechanism and casing, with the LED removed.

FIGS. 1–3 show the finger digit light 2 having a housing (generally shown as 18) with a cover 26. The cover may be removed for placing a power source (e.g., a battery) within the housing 18. The housing also has a wrist strap 4 for securing the housing to a wrist of a person. The circuitry in the housing 18 is connected to a light output device casing 8 by means of an electrical cable 6. The light output device casing 8, which is at a distal end from the housing 18 along the cable 6, houses a light-emitting diode (LED) 20 that is electrically connected by means of an internal connector 22 to the power source in the housing 18. The internal connector 22 can simply be a pair of conductive wires, as depicted in FIG. 5. In an alternative embodiment, at the light emitting end of the LED 20 a lens (not shown) can be mounted at opening 10 for focusing the light output from the LED 20. Attached to the light output device casing 8 is a finger attachment or clip 12 for securing the casing 8 to the finger. In the preferred embodiment, the finger attachment clip 12 is a resilient finger strap attached to the casing 8. The end 13 of the finger attachment clip 12 is purposely extended to allow the user to easily open the finger attachment clip 12 when inserting or removing a finger.

Figure 4:
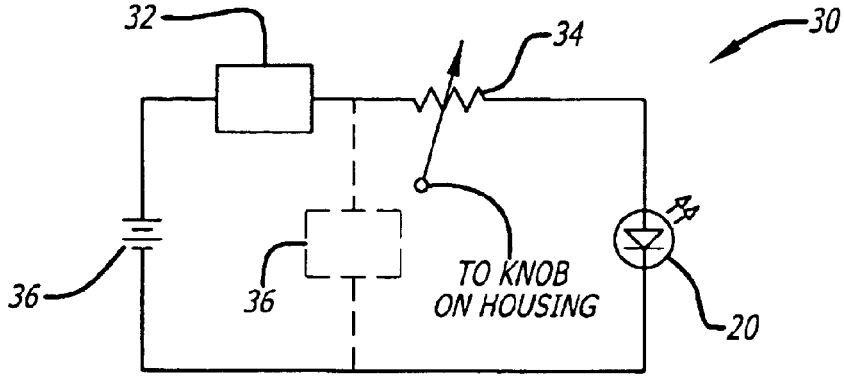
FIG. 4 is an exemplary depiction of a circuit diagram for measuring battery level and a means for controlling the light output from the LED.

Additionally, the housing 18 includes a knob 14 for controlling the light output from the LED 20. Specifically, the knob 14 is used for adjusting the resistance of a light output controlling means (viz., a potentiometer) 34 as shown in FIG. 4. By turning the knob 14 to the "Lo" position, the resistance introduced by resistor 34 is maximum thereby providing a low intensity light output from the LED 20. This is useful for conserving battery power in situations where it is desired. By turning the knob 14 to the "Hi" position, the resistance introduced by resistor 34 is minimum thereby providing a high intensity light output from the LED 20. This is useful for critical applications where a lot of light is desired (e.g., during a surgery). Optionally, an on-off switch 24 may be provided on the housing for switching the LED on or off.

Furthermore, it is possible to monitor the power source's current or voltage levels by means of an indicator 16 located on the housing 18 (FIGS. 1–3). The indicator 16 can be a series of lights, a pointer or any other simple, inexpensive power level indicator. As can be seen in FIG. 4, the measurement system 32 measures the current output from the battery and displays it on the display/monitor 16 either via green LEDs or in a numerical manner. Alternatively, as can be seen in FIG. 4 (dotted lines), the alternate measurement system 36 may be used to measure the voltage output from the battery and display it on the display/monitor 16 either via green LEDs or in a numerical manner. The measurement systems are common circuits that are commercially readily available.

As one alternative embodiment, the cable 6 may be replaced with a fiber optic cable, and the LED or other type of light emitter may be placed inside the housing 18. The light would then be transmitted from the LED in the housing, through the fiber optic cable, and out of opening 10.

While the specification describes particular embodiments of the present invention, those of ordinary skill can devise variations of the present invention without departing from the inventive concept. For example, any other light output controlling means (e.g., a diode) may be used instead of a potentiometer.

We claim the following:

1. A light system producing a variable intensity light output for mounting on the wrist and finger of a user, comprising a housing; a wrist strap attached to said housing for removably securing said housing on the wrist; a cable extending from said housing for transmitting electrical energy to a light-emitting diode (LED), said LED residing at a first end of the cable, wherein the first end of the cable is distal to the housing; a finger attachment for securing said LED to the finger; a power source within the housing for delivering a current to the LED, and a light intensity control connected to the housing for controlling the light output from the LED.

2. The light system of claim 1, wherein the light intensity control includes a potentiometer.

3. The light system of claim 1, further including a display on the housing for monitoring the current output from the power source.

4. The light system of claim 1, wherein the light intensity control is connected electrically between the power source and the LED.

5. The light system of claim 1, wherein the power source is a battery.

6. The light system of claim 1, wherein said finger attachment comprises a finger strap attached to a casing that houses the LED.

7. The light system of claim 1, further including a display on the housing for monitoring the voltage output from the power source.

8. The light system of claim 1, wherein said finger attachment comprises a clip attached to a casing that houses the LED.

9. The fiber optic finger light of claim 1, further including a lens at the light emitting end of the LED.

10. A fiber optic finger light system producing a variable intensity light output for mounting on the wrist and finger of a user, comprising: a housing; a wrist strap attached to said housing for removably securing said housing to the wrist; a fiber optic cable extending from said housing for transmitting light from a light-emitting diode (LED) in the housing; said LED residing in the housing near an end of the cable; a finger attachment for securing a second end of the cable to the finger; a power source within the housing for delivering a current to the LED, and a light intensity control means connected to the housing for controlling the light output from the LED.

11. The fiber optic finger light of claim 10, wherein the light intensity control means includes a potentiometer.

12. The fiber optic finger light of claim 10, further including a display on the housing for monitoring the current output from the power source.

13. The fiber optic finger light of claim 10, wherein the light intensity control means is connected electrically between the power source and the LED.

14. The fiber optic finger light of claim 10, wherein the power source is a battery.

15. The fiber optic finger light of claim 10, wherein said finger attachment further comprises a finger strap attached to a casing that houses the LED.

16. The fiber optic finger light of claim 10, further including a display on the housing for monitoring the voltage output from the power source.

17. The fiber optic finger light of claim 10, further including a lens at the light emitting end of the cable.

* * * * *